US011749160B2

(12) United States Patent
Chen et al.

(10) Patent No.: US 11,749,160 B2
(45) Date of Patent: Sep. 5, 2023

(54) LEVEL CONVERSION CIRCUIT, DRIVING CIRCUIT FOR DISPLAY PANEL, AND DISPLAY APPARATUS

(71) Applicants: FUZHOU BOE OPTOELECTRONICS TECHNOLOGY CO., LTD., Fujian (CN); BOE TECHNOLOGY GROUP CO., LTD., Beijing (CN)

(72) Inventors: Xin Chen, Beijing (CN); Kai Diao, Beijing (CN); Qingna Hou, Beijing (CN); Meizhen Chen, Beijing (CN); Hongzhou Xie, Beijing (CN); Renhui Yu, Beijing (CN); Ying Tian, Beijing (CN); Xiaoyang Liu, Beijing (CN); Zhiqun Chen, Beijing (CN); Wenfeng Chen, Beijing (CN)

(73) Assignees: Fuzhou BOE Optoelectronics Technology Co., LTD, Fujian (CN); BOE Technology Group Co., LTD, Beijing (CN)

( * ) Notice: Subject to any disclaimer, the term of this patent is extended or adjusted under 35 U.S.C. 154(b) by 0 days.

(21) Appl. No.: 17/907,754

(22) PCT Filed: Oct. 12, 2021

(86) PCT No.: PCT/CN2021/123312

§ 371 (c)(1),
(2) Date: Aug. 29, 2022

(87) PCT Pub. No.: WO2022/111089

PCT Pub. Date: Jun. 2, 2022

(65) Prior Publication Data

US 2023/0106665 A1 Apr. 6, 2023

(30) Foreign Application Priority Data

Nov. 27, 2020 (CN) ..... 202011367804.7

(51) Int. Cl.
*G09G 3/20* (2006.01)

(52) U.S. Cl.
CPC ..... *G09G 3/20* (2013.01); *G09G 2310/0267* (2013.01); *G09G 2310/0289* (2013.01);
(Continued)

(58) Field of Classification Search
CPC ..... G09G 3/20; G09G 2310/0267; G09G 2310/0289; G09G 2310/0291; G09G 2320/041; G09G 2330/021
See application file for complete search history.

(56) References Cited

U.S. PATENT DOCUMENTS

2018/0082638 A1* 3/2018 Shaeffer ..... G09G 3/3275
2020/0073122 A1* 3/2020 Rothkopf ..... G02B 27/017
2020/0076182 A1* 3/2020 Huang ..... G09G 3/36

* cited by examiner

*Primary Examiner* — Sejoon Ahn
(74) *Attorney, Agent, or Firm* — Lippes Mathias LLP

(57) ABSTRACT

Provided is a level conversion circuit. The level conversion circuit includes at least two level conversion sub-circuits; and each of the level conversion sub-circuits is further connected to at least one first power supply terminal, at least one second power supply terminal and at least one of a plurality of output signal terminals, wherein the first power supply signals provided by the first power supply terminals connected to the at least two level conversion sub-circuits are at different levels, and the second power supply signals provided by the second power supply terminals connected to the at least two level conversion sub-circuits are at different levels.

20 Claims, 10 Drawing Sheets

(52) U.S. Cl.
CPC ..... *G09G 2310/0291* (2013.01); *G09G 2320/041* (2013.01); *G09G 2330/021* (2013.01)

LEVEL CONVERSION CIRCUIT, DRIVING CIRCUIT FOR DISPLAY PANEL, AND DISPLAY APPARATUS

CROSS-REFERENCE TO RELATED APPLICATION

This application is a 371 of PCI application No. PCT/CN2021/123312, filed on Oct. 12, 2021, which claims priority to Chinese Patent Application No. 202011367804.7, filed on Nov. 27, 2020 and entitled "LEVEL CONVERSION CIRCUIT, DISPLAY PANEL DRIVE CIRCUIT, AND DISPLAY APPARATUS", the contents of which are incorporated herein by reference in their entirety.

TECHNICAL FIELD

The present disclosure relates to the field of display technologies, and in particular relates to a level conversion circuit, a driving circuit for a display panel and a display apparatus.

BACKGROUND

The gate driver on array (GOA) technology is a technology that integrates a gate driving circuit on an array substrate, and a circuit integrated with the GOA technology is also referred to as a GOA circuit.

SUMMARY

The present disclosure provides a level conversion circuit, a driving circuit for a display panel and a display apparatus. The technical solutions are as follows.

In one aspect of the present disclosure, a level conversion circuit is provided. The level conversion circuit includes:

at least two level conversion sub-circuits; and at least one first switch sub-circuit; wherein each of the at least one first switch sub-circuit is connected to at least one of a plurality of input control terminals and at least one of the level conversion sub-circuits; and each of the at least one first switch sub-circuit is configured to provide the input control signal provided by each connected input control terminal to the connected level conversion sub-circuit in response to a first switch control signal; and each of the level conversion sub-circuits is further connected to at least one first power supply terminal, at least one second power supply terminal and at least one of a plurality of output signal terminals, each of the output signal terminals being further connected to a gate driving circuit; and each of the level conversion sub-circuits is configured to transmit, in response to the received input control signal, a first power supply signal provided by one first power supply terminal or a second power supply signal provided by one second power supply terminal to each connected output signal terminal;

wherein the first power supply signals provided by the first power supply terminals connected to the at least two level conversion sub-circuits are at different levels, and the second power supply signals provided by the second power supply terminals connected to the at least two level conversion sub-circuits are at different levels.

In some implementations, each of the at least one first switch sub-circuit includes a plurality of first switches; wherein a control terminal of each of the first switches is configured to receive the first switch control signal, a first terminal of each of the first switches is connected to one of the plurality of input control terminals, and a second terminal of each of the first switches is connected to one of the level conversion sub-circuits.

In some implementations, a number of the first switches in each of the at least one first switch sub-circuit is the same as a number of the plurality of input control terminals, and the first switches are connected to the input control terminals in one-to-one correspondence.

In some implementations, the level conversion circuit includes a plurality of first switch sub-circuits; wherein each of the plurality of first switch sub-circuits is connected to the plurality of input control terminals and one of the level conversion sub-circuits, and each of the level conversion sub-circuits is connected to the plurality of output signal terminals.

In some implementations, each of the level conversion sub-circuits is connected to a plurality of first power supply terminals and one second power supply terminal; and the level conversion circuit further includes a switch control sub-circuit and at least two second switch sub-circuits, a number of the second switch sub-circuits in the level conversion circuit being the same as a number of the level conversion sub-circuits; wherein the switch control sub-circuit is connected to each of the second switch sub-circuits, and configured to transmit a second switch control signal to each of the second switch sub-circuits; and each of the second switch sub-circuits is further connected to a plurality of first initial power supply terminals and a plurality of first power supply terminals, the plurality of first initial power supply terminals being in one-to-one correspondence with the plurality of first power supply terminals; and each of the second switch sub-circuits is configured to transmit, in response to the second switch control signal, a first initial power supply signal provided by one first initial power supply terminal to one corresponding first power supply terminal, wherein the first initial power supply signals provided by, the plurality of first initial power supply terminals are at different levels.

In some implementations, the switch control sub-circuit includes a temperature detection secondary circuit and a switch control secondary circuit; wherein the temperature detection secondary circuit is connected to the switch control secondary circuit, and configured to transmit an initial control signal to the switch control secondary circuit based on detected temperature; and the switch control secondary circuit is connected to each of the second switch sub-circuits, and configured to transmit a second switch control signal to each of the second switch sub-circuits based on the initial control signal.

In some implementations, the temperature detection secondary circuit includes a thermistor, a first resistor and a capacitor; and the switch control secondary circuit includes a current source, a second resistor and a third resistor; wherein one end of the thermistor and one end of the capacitor are both connected to a first DC power supply terminal, the other end of the thermistor is connected to a first node, and the other end of the capacitor is connected to a second DC power supply terminal;

one end of the first resistor is connected to the first node, and the other end of the first resistor is connected to the second DC power supply terminal;

the current source is connected to the first node and one end of the second resistor, and the other end of the second resistor is connected to a second node; and one end of the third resistor is connected to the second node, the other end of the third resistor is connected to the second DC power supply terminal, and the second node is connected to each second switch sub-circuit.

In some implementations, each of the second switch sub-circuits includes a plurality of second switches; wherein a control terminal of each of the second switches is connected to the switch control sub-circuit, a first terminal of each of the second switches is connected to one first initial power supply terminal, and a second terminal of each of the second switches is connected to one first power supply terminal.

In some implementations, each of the level conversion sub-circuits is connected to two first power supply terminals; and each of the second switch sub-circuits is connected to two first initial power supply terminals and includes two second switches.

in some implementations, the level conversion circuit further includes at least two amplification sub-circuits, a number of the amplification sub-circuits in the level conversion circuit being the same as the number of the level conversion sub-circuits; wherein an input terminal of each of the amplification sub-circuits is connected to one of the two first initial power supply terminals, and an output terminal of each of the amplification sub-circuits is connected to the other of the two first initial power supply terminals; and each of the amplification sub-circuits is configured to amplify a first initial power supply signal provided by one of the first initial power supply terminals and transmits the amplified first initial power supply signal to the other of the first initial power supply terminals.

in some implementations, each of the amplification sub-circuits includes an amplifier, a fourth resistor and a fifth resistor; wherein a positive input terminal of the amplifier is connected to one of the two first initial power supply terminals, a negative input terminal of the amplifier is connected to one end of the fourth resistor and one end of the fifth resistor, and an output terminal of the amplifier is connected to the other of the two first initial power supply terminals;

the other end of the fourth resistor is connected to a second DC power supply terminal; and the other end of the fifth resistor is connected to the output terminal of the amplifier.

In some implementations, the level conversion circuit further includes an inverter sub-circuit; wherein the inverter sub-circuit is connected to the plurality of input control terminals and each first switch sub-circuit; and configured to invert an input control signal provided by each of the input control terminals and transmits the input control signal to each first switch sub-circuit.

In some implementations, the inverter sub-circuit includes a plurality of NOT gates; wherein an input terminal of each of the NOT gates is connected to one of the input control terminals, and an output terminal of each of the NOT gates is connected to a first terminal of one first switch in each first switch sub-circuit.

In some implementations, the level conversion circuit includes two level conversion sub-circuits.

In some implementations; the level conversion circuit includes two first switch sub-circuits.

In some implementations, each of the level conversion sub-circuits includes a first transistor and a second transistor; wherein a gate of the first transistor is connected to one of the two first switch sub-circuits, a first electrode of the first transistor is connected to at least one first power supply terminal, and a second electrode of the first transistor is connected to at least one of the output signal terminals; and a gate of the second transistor is connected to the other of the two first switch sub-circuits, a first electrode of the second transistor is connected to at least one second power supply terminal, and a second electrode of the second transistor is connected to at least one of the output signal terminals.

In another aspect of the present disclosure, a driving circuit for a display panel is provided. The driving circuit for the display panel includes a gate driving circuit, and the level conversion circuit described in the above aspect.

The level conversion circuit is connected to the gate driving circuit and configured to provide a driving signal to the gate driving circuit, and the gate driving circuit is configured to operate under the drive of the driving signal.

In some implementations, a transistor in the gate driving circuit is made of a metal oxide semiconductor material.

in still another aspect of the present disclosure, a display apparatus is provided. The display apparatus includes a display panel, and the driving circuit for the display panel described in the above aspect.

The driving circuit for the display panel is connected to the display panel, and configured to drive the display panel to display.

BRIEF DESCRIPTION OF THE DRAWINGS

For clearer descriptions of the technical solutions in the embodiments of the present disclosure, the following briefly introduces the accompanying drawings required for describing the embodiments. Apparently, the accompanying drawings in the following description show merely some embodiments of the present disclosure, and persons of ordinary skill in the art may still derive other drawings from these accompanying drawings without creative efforts.

DETAILED DESCRIPTION

For clearer descriptions of the objectives, technical solutions, and advantages of the inventive concept of the embodiments of the present disclosure, the inventive concept of the embodiments of the present disclosure is described in detail hereinafter with reference to the accompanying drawings and some embodiments.

in the related art, a GOA circuit may be connected to a plurality of signal terminals (such as a clock signal terminal and an AC power supply terminal), and the plurality of signal terminals may be connected to a level conversion circuit. The level conversion circuit may provide a signal to each signal terminal, and the GOA circuit may operate under the drive of the signal from the signal terminals. Moreover, the level conversion circuit provides the signals at the same high level or low level to the signal terminals.

Figure 1:
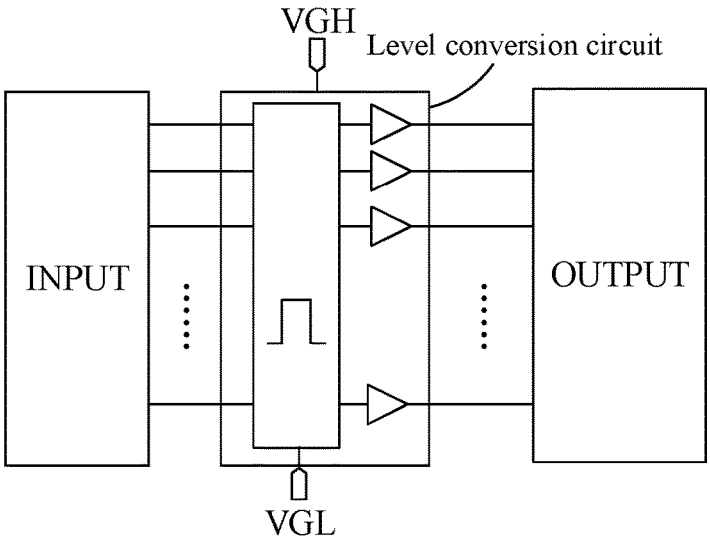
FIG. 1 (Prior Art)
FIG. 1 is a structural schematic diagram of a level conversion circuit in the related art.

FIG. 1 is a structural diagram of a level conversion circuit in the related art. As shown in FIG. 1, one end of the level conversion circuit is connected to an input terminal INPUT, the other end of the level conversion circuit is connected to an output terminal OUTPUT, and the output terminal OUTPUT may be then connected to each signal terminal of a GOA circuit. Moreover, a high-level signal transmitted by the level conversion circuit to the output terminal OUTPUT only has a level of VGH, and a low-level signal transmitted by the level conversion circuit to the output terminal OUTPUT only has a level of VGL. It is found through tests carried out at a high temperature higher than a normal temperature and at a low temperature lower than the normal temperature that, when the GOA circuit drives a display panel under the drive of the signal provided by the level conversion circuit, abnormal display (AD) easily occurs on the display panel, resulting in poor reliability of a product (i.e., a display apparatus).

In order to solve the above technical problem, an embodiment of the present disclosure provides a new level conversion circuit to provide a signal to each signal terminal of the GOA circuit. It is found through tests that when the level conversion circuit is used to provide signals to the GOA circuit, the AD phenomenon of the display panel occurring at the high temperature and at the low temperature in the related art can be effectively solved. Thus, it can be determined that the product with the level conversion circuit has better reliability.

Figure 2:
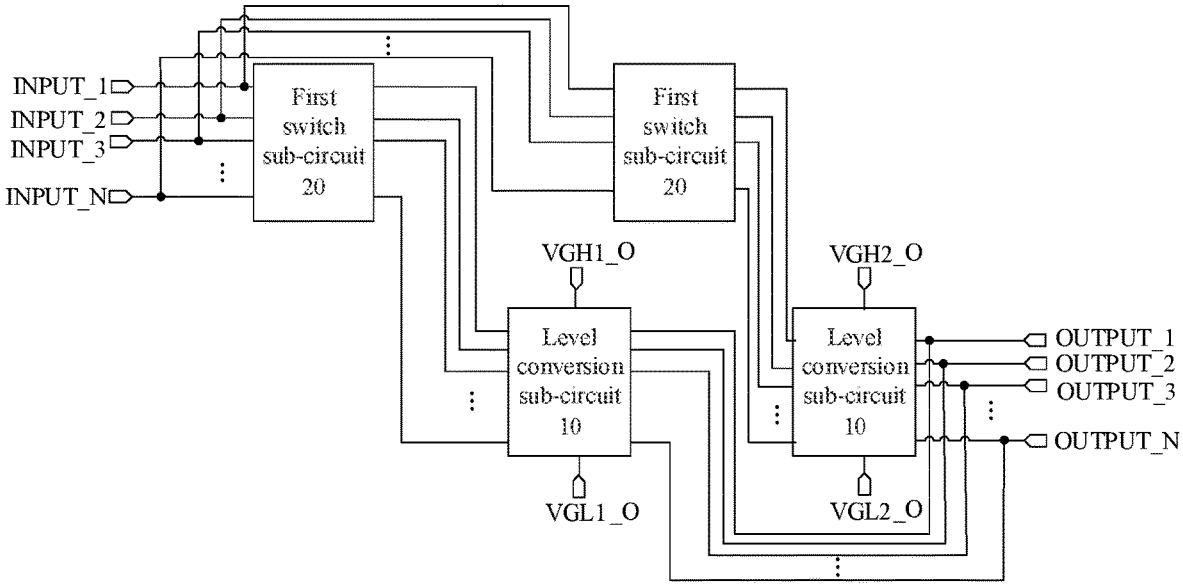
FIG. 2 is a structural schematic diagram of a level conversion circuit according to an embodiment of the present disclosure.

FIG. 2 is a structural schematic diagram of a level conversion circuit according to an embodiment of the present disclosure. As shown in FIG. 2, the level conversion circuit may include at least two level conversion sub-circuits 10 and at least one first switch sub-circuit 20.

Each first switch sub-circuit 20 may be connected to at least one of a plurality of input control terminals and at least one level conversion sub-circuit 10. Each first switch sub-circuit 20 may be configured to provide an input control signal provided by each of the connected input control terminals to the connected level conversion sub-circuit 10 in response to a first switch control signal.

For example, referring to FIG. 2, the illustrated level conversion circuit totally includes two level conversion sub-circuits 10 and two first switch sub-circuits 20 and each first switch sub-circuit 20 is connected to a plurality of input control terminals INPUT_1 to INPUT_N and one level conversion sub-circuit 10. Here, N is a positive integer greater than 1. When receiving the first switch control signal at an effective level, each first switch sub-circuit 20 may provide the input control signal provided by each of the connected input control terminals to the connected level conversion sub-circuit 10. Thus, the input control signal received by each level conversion sub-circuit 10 may be adjusted by flexibly setting the first switch control signal.

In some embodiments, the first switch control signal may be provided by a power management integrated circuit (PMIC). That is, each first switch sub-circuit 20 may further be connected to the PMIC to receive the first switch control signal transmitted by the PMIC.

Each level conversion sub-circuit 10 may further be connected to at least one first power supply terminal, at least one second power supply terminal and at least one of a plurality of output signal terminals. Each output signal terminal may further be connected to a gate driving circuit (i.e., the GOA circuit). Each level conversion sub-circuit 10 may be configured to, in response to the received input control signal, transmit a first power supply signal provided by one of the first power supply terminals or a second power supply signal provided by one of the second power supply terminals to each of the connected output signal terminals.

In some implementations of the present disclosure, the number of the output signal terminals may be the same as the number of the input control terminals, and the output signal terminals may be in one-to-one correspondence with input control terminals. That is, as shown in FIG. 2, the level conversion circuit may include N input control terminals INPUT_1 to INPUT_N, and N output signal terminals OUTPUT_1 to OUTPUT_N in one-to-one correspondence with the N input control terminals INPUT_1 to INPUT_N. In addition, the first power supply signals provided by the first power supply terminals connected to the respective level conversion sub-circuits 10 may be at different levels, and the second power supply signals provided by the second power supply terminals connected to the respective level conversion sub-circuits 10 may be at different levels.

For example, with continuous reference to FIG. 2, in the illustrated two level conversion sub-circuits 10, one level conversion sub-circuits 10 (referred to as a first level conversion sub-circuit 10 in the following embodiments) is connected to one first power supply terminal VGH1_O, one second power supply terminal VGL1_O and the plurality of output signal terminals OUTPUT_1 to OUTPUT_N; and the other level conversion sub-circuits 10 (referred to as a second level conversion sub-circuit 10 in the following embodiments) is connected to one first power supply terminal VGH1_O, one second power supply terminal VGL1_O and the plurality of output signal terminals OUTPUT_1 to OUTPUT The level of the first power supply signal provided by the first power supply terminal VGH2_O is different from the level of the first power supply signal provided by first power supply terminal VGH2_O, and the level of the second power supply signal provided by the second power supply terminal VGL1_O is different from the level of the second power supply signal provided by the second power supply terminal VGL2_O.

Furthermore, when receiving an input control signal at a first level, each level conversion sub-circuit 10 may transmit the first power supply signal provided by the connected first power supply terminal to each of the connected output signal terminals; and when receiving an input control signal at a second level, each level conversion sub-circuit 10 may transmit the second power supply signal provided by the connected second power supply terminal to each of the connected output signal terminals. For example, for the first level conversion sub-circuit 10, when receiving an input control signal at the first level, the first level conversion sub-circuit 10 may transmit the first power supply signal provided by the first power supply terminal WWII 0 to each of the output signal terminals; and when receiving an input control signal at the second level, the first level conversion sub-circuit 10 may transmit the second power supply signal provided by the second power supply terminal VGL1_O to each of the output signal terminals. The same applies to the second level conversion sub-circuit 10, and details are not repeated herein.

One of the first level and the second level may be a high level, the other may be a low level, and both levels may be effective levels. One of the first power supply signal and the second power supply signal may be at the high level, and the other may be at the low level. In this way, both low-level signals and high-level signals may be provided to the GOA circuit, and the first power supply signals at different high levels and the second power supply signals at different low levels may be provided to the GOA circuit.

It is to be noted that each output signal terminal of the level conversion circuit according to the embodiment of the present disclosure may be different signal terminals connected to the GOA circuit, such as a clock signal terminal CLK, a switch-on signal terminal STV, a reset signal terminal RST or an AC power supply terminal V1. Thus, based on the descriptions of the above embodiment, it can be known that signals at different high levels or signals at different low levels may be provided to different signal terminals connected to the GOA circuit by adopting the level conversion circuit. It's found through the tests that, by providing signals at different high levels and signals at different low levels to different signal terminals connected to the GOA circuit, the AD phenomenon of the display panel occurring at the high temperature and at the low temperature can be effectively solved, thereby improving the product reliability and ensuring a better display effect.

In summary, the embodiment of the present disclosure provides a level conversion circuit. The level conversion circuit includes at least one first switch sub-circuit and at least two level conversion sub-circuits. Each first switch sub-circuit may control each level conversion sub-circuit to transmit a first power supply signal or a second power supply signal to a gate driving; circuit, and the first power supply signals provided by the respective level conversion sub-circuits are at different levels, and the second power supply signals provided by the respective level conversion sub-circuits are at different levels. Therefore, the first power supply signals at different levels and the second power supply signals at different levels can be provided to different signal terminals connected to the gate driving circuit, thereby improving the product reliability, and achieving the better display effect of the display panel.

Figure 3:
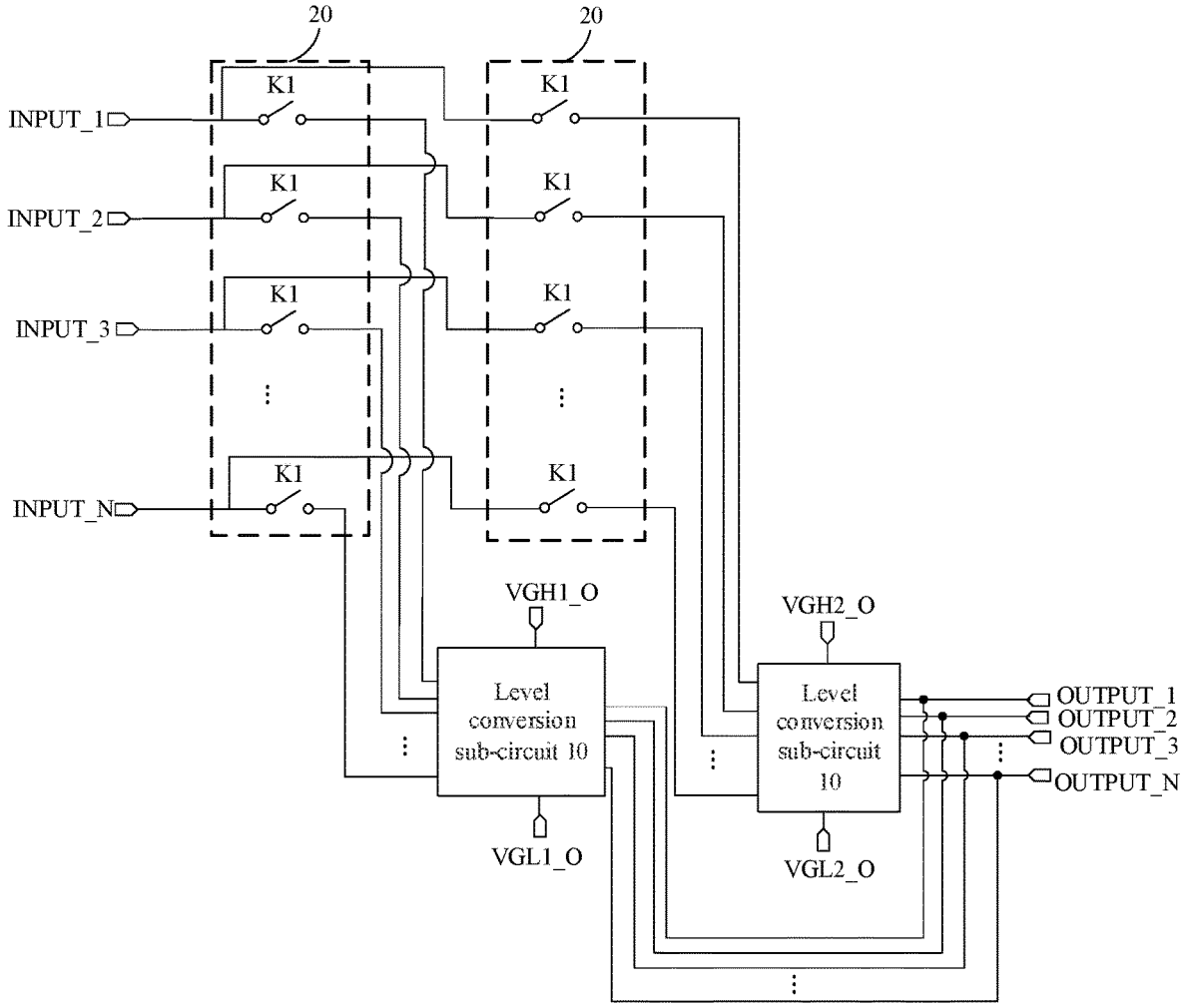
FIG. 3 is a structural schematic diagram of another level conversion circuit according to an embodiment of the present disclosure.

In some implementations, FIG. 3 is a structural schematic diagram of another level conversion circuit according to another embodiment of the present disclosure. As shown in FIG. 3, each first switch sub-circuit 20 may include a plurality of first switches K1.

A control terminal of each first switch K1 may be configured to receive a first switch control signal, a first terminal of each first switch K1 may be connected to one input control terminal, and a second terminal of each first switch K1 may be connected to one level conversion sub-circuit 10.

For example, referring to FIG. 3, the first terminals of the first switches K1 in each first switch sub-circuit 20 are connected to the input control terminals INPUT_1 to INPUT_N, respectively. The second terminals of the first switches K1 in one of the first switch sub-circuits 20 are all connected to the first level conversion sub-circuit 10, and the second terminals of the first switches K1 in the other first switch sub-circuit 20 are all connected to the second level conversion sub-circuit 10.

In addition, it may be determined based on the structure of the first switch sub-circuit 20 shown in FIG. 3 that, in the embodiment of the present disclosure, each first switch sub-circuit 20 operates according to the following principle. For each first switch K1, in the case that the first switch control signal received by a control terminal of the first switch K1 is at the effective level, the first terminal and the second terminal of the first switch K1 are conducted. Correspondingly, the input control signal provided by the input control terminal connected to the first terminal of the first switch K1 can be further transmitted to the level conversion sub-circuit 10 connected to the second terminal of the first switch K1 via the first switch K1. In the case that the first switch control signal received by the control terminal of the first switch K1 is at an ineffective level, the first terminal and the second terminal of the first switch K1 are non-conducted, and the input control signal provided by the input control terminal connected to the first terminal of the first switch K1 cannot be further transmitted to the level conversion sub-circuit 10 connected to the second terminal of the first switch K1.

For example, for the first switch K1 connected to the input control terminal INPUT_1 and the first level conversion sub-circuit 10, when the control terminal of the first switch K1 receives the first switch control signal at the effective level, the first terminal and the second terminal of the first switch K1 are conducted. In this case, the input control signal provided by the input control terminal INPUT_1 may be transmitted to the first level conversion sub-circuit 10 via the first switch K1.

It is to be noted that, with reference to the level conversion circuit shown in FIG. 2 or FIG. 3, in order to avoid two level conversion sub-circuits 10 from transmitting the same power supply signal at different levels to the same output signal terminal, each level conversion sub-circuit 10 may be preset to operate following different first switch sub-circuits 20, that is, each level conversion sub-circuit 10 may be set to operate in response to the signals transmitted by different first switch sub-circuits 20. Alternatively, it may be controlled that the first switch control signals at different levels are provided to the first switches K1 that are in different first switch sub-circuits 20 and connected to the same input control terminal.

In some implementations, with reference to the structure shown in FIG. 3, the number of the first switches K1 in each first switch sub-circuit 20 may be the same as the number of the plurality of input control terminals. In this way, on the premise of reliably transmitting the input control signal provided by each input control terminal to the level conversion sub-circuit 10, the problems such as a large area of circuit caused by many first switches and high costs may be avoided. Certainly, the number of first switches K1 may also be greater than the number of input control terminals.

Figure 4:
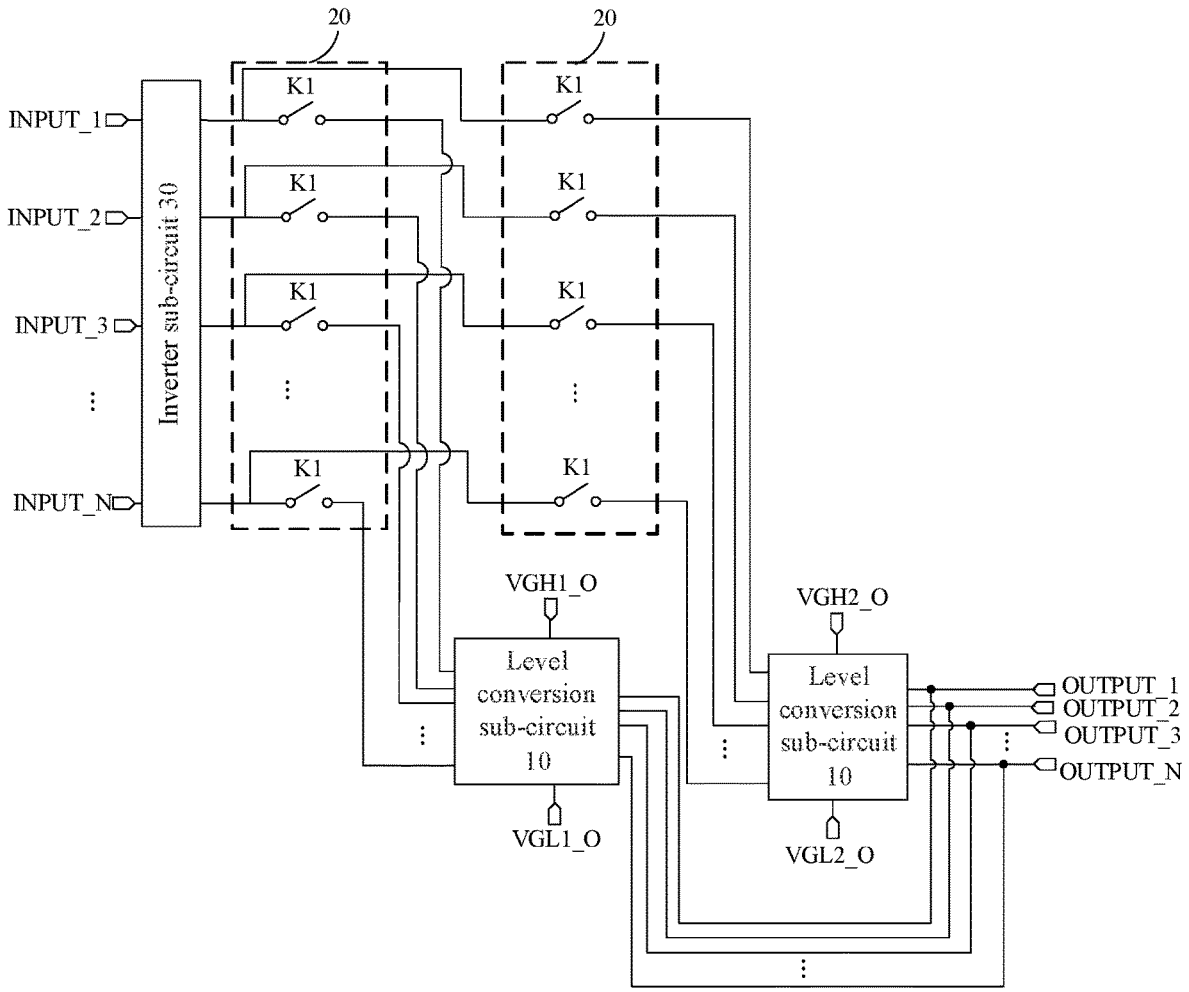
FIG. 4 is a structural schematic diagram of still another level conversion circuit according to an embodiment of the present disclosure.

In some implementations, FIG. 4 is a structural schematic diagram of still another level conversion circuit according to an embodiment of the present disclosure. As shown in FIG. 4, the level conversion circuit may further include an inverter sub-circuit 30.

The inverter sub-circuit 30 may be connected to the plurality of input control terminals INPUT_1 to INPUT_N and each of the first switch sub-circuits 20.

in some implementations, as shown in FIG. 4, the inverter sub-circuit 30 may be connected to the first terminal of each first switch K1 in each first switch sub-circuit 20. The inverter sub-circuit 30 may be configured to invert an input control signal provided by each input control terminal and transmit the input control signal to each first switch sub-circuit 20.

For example, the inverter sub-circuit 30 may invert the input control signal at the first level into the input control signal at the second level, and transmit the input control signal at the second level to each first switch sub-circuit 20. Similarly, the inverter sub-circuit 30 may invert the input control signal at the second level into the input control signal at the first level, and transmit the input control signal at the first level to each first switch sub-circuit 20. In this way, the stability of signal transmission can be ensured, and the level of the signal finally transmitted to the output signal terminal keeps consistent with the level of the input control signal provided by the input control terminal.

Figure 5:
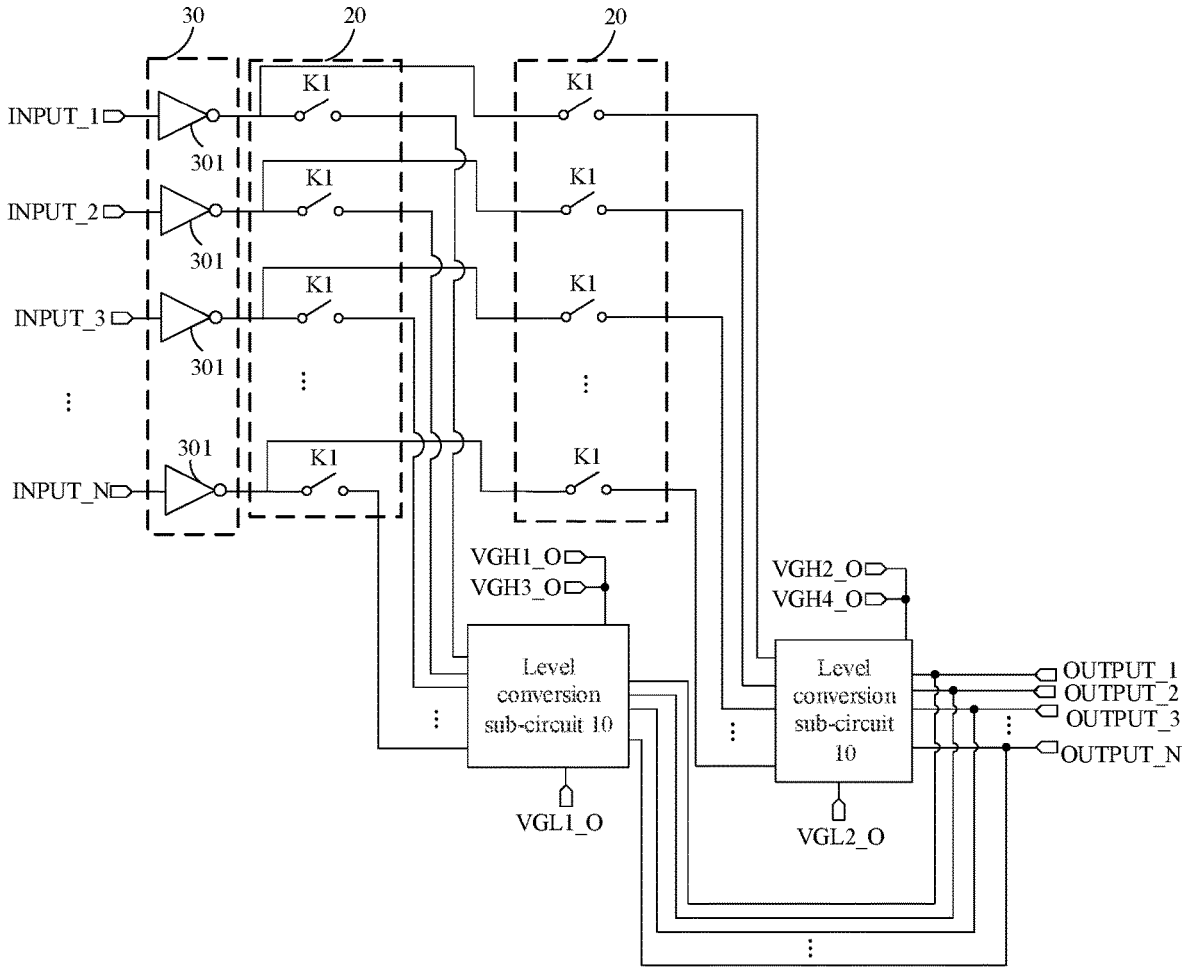
FIG. 5 is a structural schematic diagram of still another level conversion circuit according to an embodiment of the present disclosure.

In some implementations, FIG. 5 is a structural schematic diagram of still another level conversion circuit according to an embodiment of the present disclosure. As shown in FIG. 5, the inverter sub-circuit 30 may include a plurality of NOT gates 301.

An input terminal of each NOT gate 301 may be connected to one input control terminal, and an output terminal of each NOT gate 301 may be connected to a first terminal of one first switch K1 in each first switch sub-circuit 20.

In some implementations, in order to ensure the inversion control of the input control signal provided by each input control terminal, the number of the NOT gates 301 in the inverter sub-circuit 30 may be same as the number of the input control terminals. Certainly, the number of NOT gates 301 may also be less than or greater than the number of the input control terminals, which is not limited in the embodiments of the present disclosure.

In some implementations, each level conversion sub-circuit 10 in the present disclosure may be connected to a plurality of first power supply terminals and one second power supply, terminal. For example, referring to the level conversion circuit shown in FIG. 5 and FIG. 6, the first level conversion sub-circuit 10 may be connected to two first power supply terminals VGH1_O and VGH3_O and one second power supply terminal VGL1_O, and the second level conversion sub-circuit 10 may be connected to two first power supply terminals VGH2_O and VGH4_O and one second power supply terminal VGL2_O. The following embodiments are all described by taking the structure of the level conversion circuit shown in FIG. 6 as an example.

Figure 6:
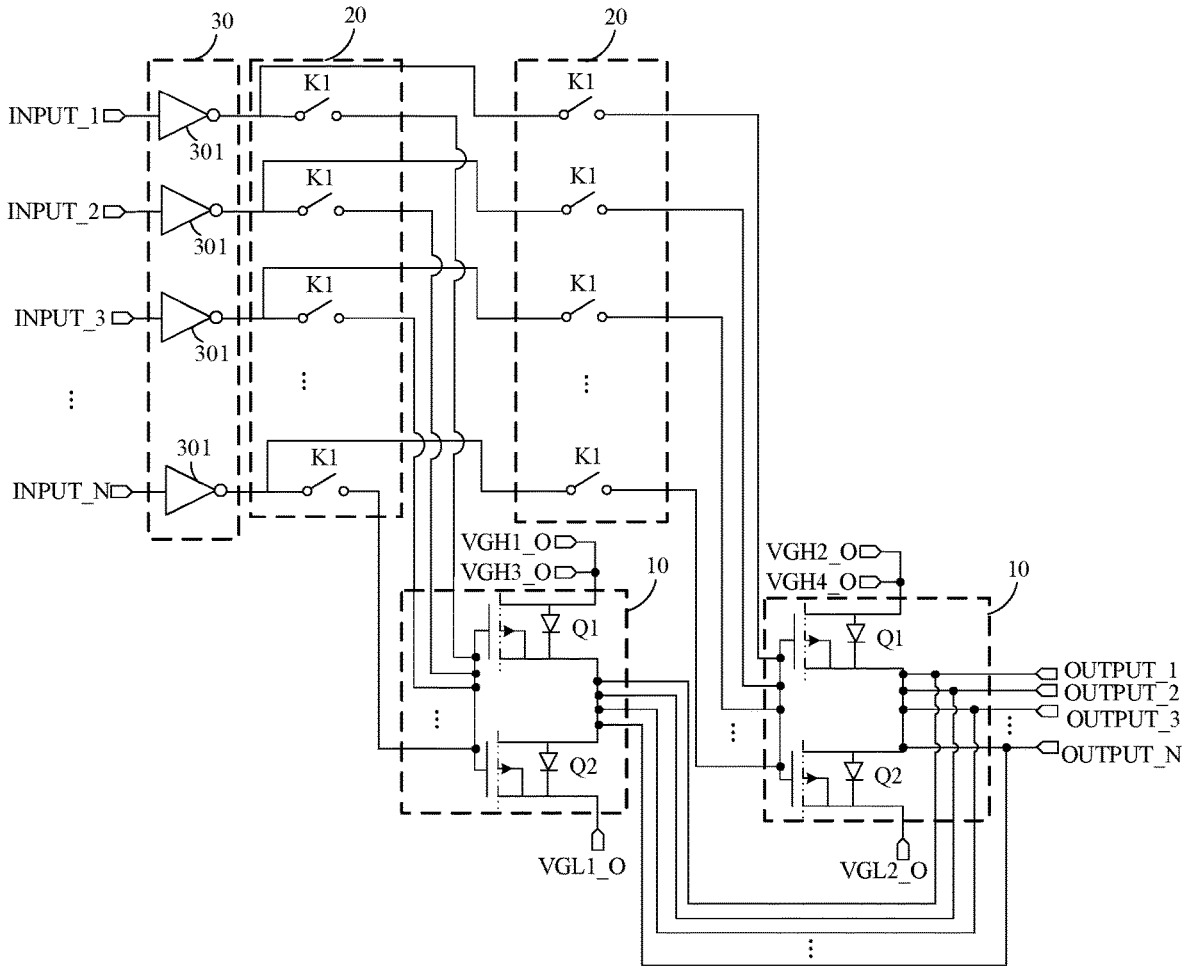
FIG. 6 is a structural schematic diagram of still another level conversion circuit according to an embodiment of the present disclosure.

With continuous reference to FIG. 6, each level conversion sub-circuit 10 may include a first transistor Q1 and a second transistor Q2.

A gate of the first transistor Q1 may be connected to the first switch sub-circuit 20, a first electrode of the first transistor Q1 may be connected to at least one first power supply terminal, and a second electrode of the first transistor Q1 may be connected to at least one output signal terminal.

A gate of the second transistor Q2 may be connected to the first switch sub-circuit 20, a first electrode of the second transistor Q2 may be connected to at least one second power supply terminal, and a second electrode of the second transistor Q2 may be connected to at least one output signal terminal.

For example, with reference to FIG. 6, the gate of each first transistor Q1 may be connected to the second terminal of the first switch K1. In the first level conversion sub-circuit 10, the first electrode of the first transistor Q1 may be connected to two first power supply terminals and VGH3_O, the first electrode of the second transistor Q2 may be connected to one second power supply terminal VGL1_O, and the second electrode of the first transistor Q1 and the second electrode of the second transistor Q2 are both connected to the plurality of output signal terminals OUTPUT_1 to OUTPUT_N. In the second level conversion sub-circuit 10, the first electrode of the first transistor Q1 may be connected to two first power supply terminals VGH2_O and VGH_O, the first electrode of the second transistor Q2 may be connected to one second power supply terminal VGL2_O, and the second electrode of the first transistor Q1 and the second electrode of the second transistor Q2 are both connected to the plurality of output signal terminals OUTPUT_1 to OUTPUT_N, It is to be noted that the first transistor Q1 and the second transistor Q2 in each level conversion sub-circuit 10 may be of different types. For example, one of the transistors may be an N-type transistor, and the other may be a P-type transistor. For the N-type transistor, the effective level may be the high level; and for the P-type transistor, the effective level may be the low level. As such, it may be determined that the operating principle of the level conversion sub-circuit 10 is as follows.

Assuming that the first transistor Q1 is an N-type transistor, and the second transistor Q2 is a P-type transistor, then for the first level conversion sub-circuit 10, when the received input control signal is at the high level, the first transistor Q1 in the first level conversion sub-circuit 10 may be turned on, and the second transistor Q2 in the first level conversion sub-circuit 10 may be turned off. The first power supply signal provided by either of the two first power supply terminals VGH1_O and VGH3_O may be transmitted to the output signal terminal via the first transistor Q1. When the received input control signal is at the low level, the first transistor Q1 in the first level conversion sub-circuit 10 may be turned off, and the second transistor Q2 in the first level conversion sub-circuit 10 may be turned on. The second power supply signal provided by the second power supply terminal VGL1_O may be transmitted to the output signal terminal via the second transistor Q2. The same principle applies to the second level conversion sub-circuit 10, and details are not repeated herein.

Based on the descriptions of the above embodiment, in order to effectively improve the reliability, the levels of signals provided by different signal terminals connected to the GOA circuit may be combined for tests, and the first switch control signals at different levels may be flexibly provided to the first switch sub-circuits 20 based on the test result, such that the levels of the signals finally transmitted to the signal terminals can ensure a better product reliability.

In an example embodiment, the following Table 1 shows a determined signal truth table by taking the level conversion circuit shown in FIG. 4 as an example, in which "K1_1" represents the first switch K1 in the first switch sub-circuit 20 connected to the first level conversion sub-circuit 10, "K1_2" represents the first switch K1 in the first switch sub-circuit 20 connected to the second level conversion sub-circuit 10, "0" represents the effective level, "1" represents the ineffective level, "x" represents not being transmitted, and "Ai" represents being transmitted.

TABLE 1

| | K1_1/ K1_2 | VGH1_O/ VGL1_O | VGH2_O/ VGL2_O |
|---|---|---|---|
| INPUT_1 | 0/1 | x | ✓ |
| INPUT_2 | 0/1 | x | ✓ |
| INPUT_3 | 0/1 | x | ✓ |
| . . . | . . . | . . . | . . . |
| INPUT_N | 1/0 | ✓ | x |

It can be seen from Table 1 that, in the first switch sub-circuit 20 connected to the first level conversion sub-circuit 10, the first switch control signals provided to the first switches K1_1 connected to the input control terminals INPUT_1 to INPUT_3 are at the ineffective level, and the first switch control signal provided to the first switch K1_1 connected to the input control terminal INPUT_N is at the effective level. In this way, the first level conversion sub-circuit 10 may transmit, based on the input control signal provided by the input control terminal INPUT_N, the first power supply signal provided by the first power supply terminal VGH1_O or the second power supply signal provided by the second power supply terminal VGL1_O to the connected output signal terminal.

Similarly, it can be seen from Table 1 that, in the first switch sub-circuit 20 connected to the second level conversion sub-circuit 10, the first switch control signals provided to the first switches K1_2 connected to the input control terminals INPUT_1 to INPUT_3 are at the effective level, and the first switch control signal provided to the first switch K1_2 connected to the input control terminal INPUT Nis at the ineffective level. In this way, the second level conversion sub-circuit 10 may transmit, based on the input control signals provided by the input control terminals INPUT_1 to INPUT_3, the first power supply signal provided by the first power supply terminal VGH2_O or the second power supply signal provided by the second power supply terminal VGL2_O to the connected output signal terminal.

After the truth table shown in Table 1 is acquired, the first switch control signal may be provided to each first switch K1 through the PMIC according to the above Table 1. In addition, Table 1 only schematically shows a combination in some embodiments, and in use, a combination which can better improve the reliability effect may be determined based on structures or materials of different GOA circuits, which is not limited in the embodiments of the present disclosure.

Figure 7:
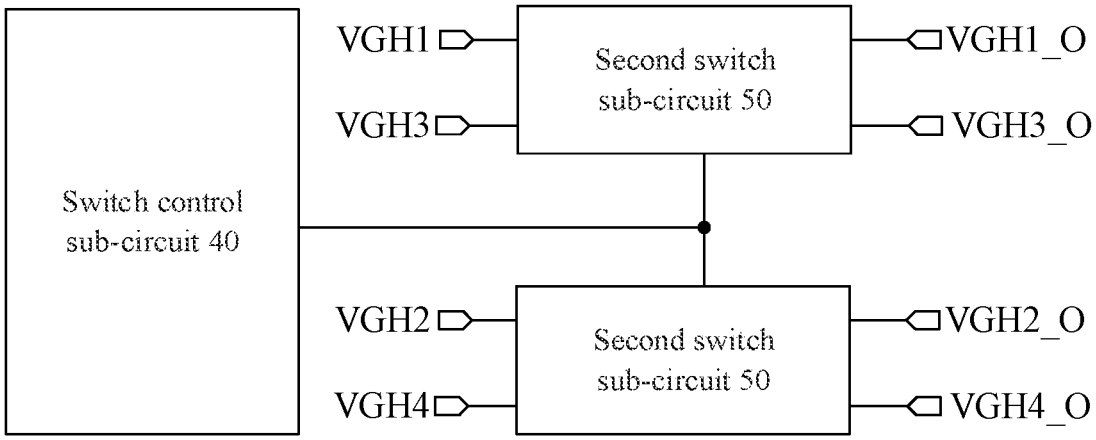
FIG. 7 is a partial structural schematic diagram of still another level conversion circuit according to an embodiment of the present disclosure.

In some implementations, when each level conversion sub-circuit 10 is connected to a plurality of first power supply terminals, in order to ensure that the first power supply signal provided by one first power supply terminal is reliably output to the output signal terminal by the level conversion sub-circuit 10. With reference to the structure shown in FIG. 6, FIG. 7 shows still another level conversion circuit. As shown in FIG. 7, the level conversion circuit may further include a switch control sub-circuit 40 and at least two second switch sub-circuits 50. The number of the second switch sub-circuits 50 is the same as the number of the level conversion sub-circuits 10. For example, FIG. 7 shows two second switch sub-circuits 50 in total.

The switch control sub-circuit 40 may be connected to each of the second switch sub-circuits 50, and configured to transmit a second switch control signal to each of the second switch sub-circuits 50.

Each of the second switch sub-circuits 50 may further be connected to a plurality of first initial power supply terminals and a plurality of first power supply terminals, and the plurality of first initial power supply terminals are in one-to-one correspondence with the plurality of first power supply terminals. That is, the number of the first initial power supply terminals connected to each second switch sub-circuit 50 is the same as the number of the first power supply terminals connected to each level conversion sub-circuit 10. Each of the second switch sub-circuits 50 may be configured to transmit, in response to the second switch control signal, a first initial power supply signal provided by one first initial power supply terminal to the corresponding first power supply terminal.

The first initial power supply signals provided by the plurality of first initial power supply terminals may be at different levels, such that one level conversion sub-circuit 10 may transmit the first initial power supply signals at the different levels to the output signal terminal.

For example, with reference to FIG. 6 and FIG. 7, each level conversion sub-circuit 10 is connected to two first power supply terminals. Correspondingly, each second switch sub-circuit 50 may be connected to two first initial power supply terminals. Here, one of the illustrated second switch sub-circuits 50 is connected to first initial power supply terminals VGH1 and VGH3, VGH1 may correspond to VGH1_O, and VGH3 may correspond to VGH3_O. The other of the second switch sub-circuits 50 is connected to first initial power supply terminals VGH2 and VGH4, VGH2 may correspond to VGH2_O, and VGH4 may correspond to VGH4_O. When receiving the second switch control signal at the effective level, each second switch sub-circuit 50 may transmit the first initial power supply signal provided by the connected one first initial power supply terminal to the corresponding first power supply terminal.

Figure 8:
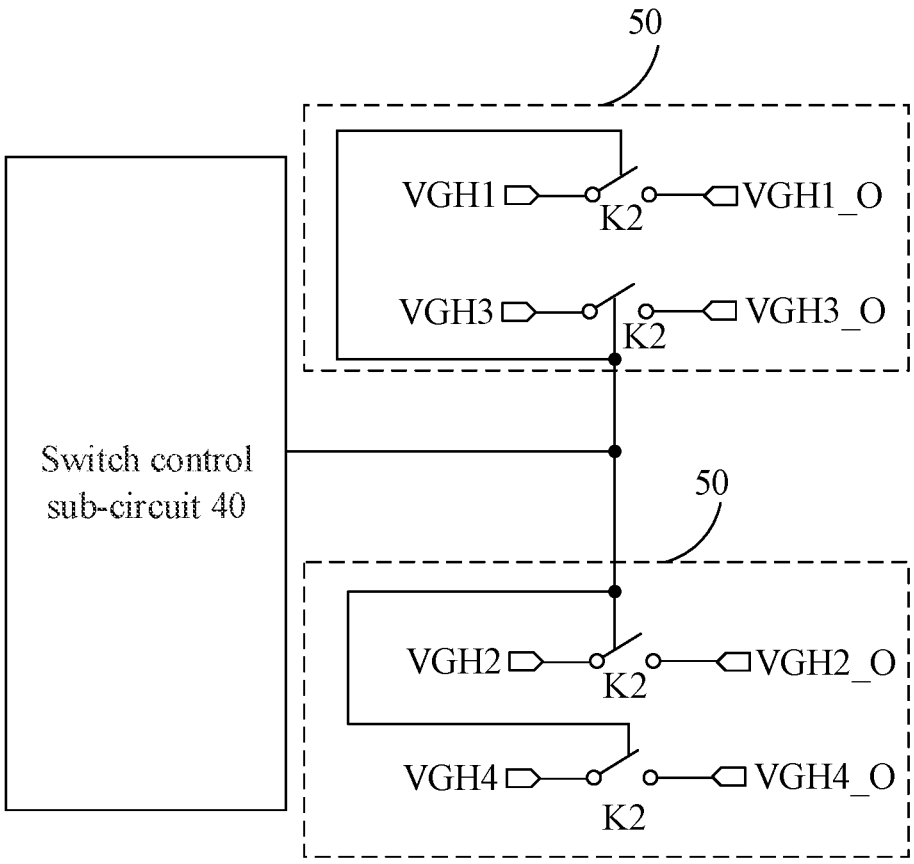
FIG. 8 is a partial structural schematic diagram of still another level conversion circuit according to an embodiment of the present disclosure.

In some implementations, FIG. 8 is a structural schematic diagram of still another level conversion circuit according to an embodiment of the present disclosure. As shown in FIG. 8, each of the second switch sub-circuits 50 may include a plurality of second switches A control terminal of each second switch K2 may be connected to the switch control sub-circuit 40, a first terminal of each second switch K2 may be connected to one first initial power supply terminal, and a second terminal of each second switch K2 may be connected to one first power supply terminal.

Therefore, when the switch control sub-circuit 40 provides the second switch control signal at the effective level to any of the second switches K2, the first terminal and the second terminal of the second switch K2 may be conducted, such that the first initial power supply signal provided by the first initial power supply terminal connected to the first terminal of the second switch K2 may be transmitted to the first power supply terminal connected to the second terminal of the second switch K2 via the second switch K2.

It is to be noted that, with reference to the structure shown in FIG. 8, in order that each second switch sub-circuit 50 can reliably transmit the initial power supply signal provided by one initial power supply terminal, the two second switches K2 in each second switch sub-circuit 50 may be of different types. That is, one of the second switches K2 may be turned on in response to the second control signal at the low level, and the other of the second switches K2 may be turned on in response to the second control signal at the high level.

Figure 9:
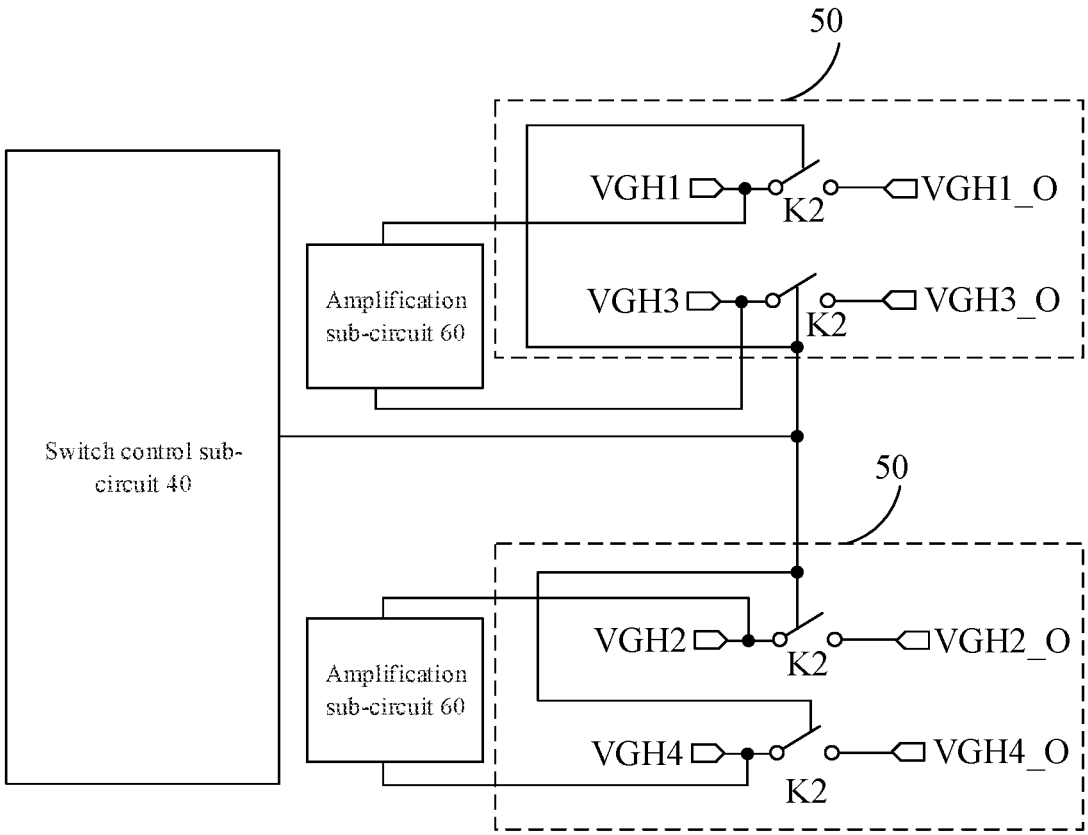
FIG. 9 is a partial structural schematic diagram of still another level conversion circuit according to an embodiment of the present disclosure.

In some implementations, with reference to the structure shown in FIG. 7 and FIG. 8, assuming that each second switch sub-circuit 50 is connected to two first initial power supply terminals in total, then referring to FIG. 9, the level conversion circuit may further include at least two amplification sub-circuits 60, and the number of the amplification sub-circuits 60 in the level conversion circuit may be the same as the number of the level conversion sub-circuits 10. For example, FIG. 9 shows two amplification sub-circuits 60 in total.

An input terminal of each amplification sub-circuit 60 may be connected to one of the two first initial power supply terminals, and an output terminal of each amplification sub-circuit 60 may be connected to the other of the two first initial power supply terminals. Each amplification sub-circuit 60 may be configured to amplify the first initial power supply signal provided by one of the first initial power supply terminals and transmit the amplified first initial power supply signal to the other of the first initial power supply terminals.

For example, referring to FIG. 9 which shows two amplification sub-circuits 60, the input terminal of one of the amplification sub-circuits 60 is connected to the first initial power supply terminal VGH1, and the output terminal thereof is connected to the first initial power supply terminal VGH3. The amplification sub-circuit 60 may amplify the first power supply signal provided by the first initial power supply terminal VGH1, and transmit the amplified first power supply signal to the first initial power supply terminal VGH3. Correspondingly, the level of the first power supply terminal VGH3_O connected to the first level conversion sub-circuit 10 may be higher than the level of the first power supply terminal VGH1_O. The input terminal of the other of the amplification sub-circuits 60 is connected to the first initial power supply terminal VGH2, and the output terminal thereof is connected to the first initial power supply terminal VGH4. The amplification sub-circuit 60 may amplify the first power supply signal provided by the first initial power supply terminal VGH2, and transmits the amplified first power supply signal to the first initial power supply terminal VGH4. Correspondingly, the level of the first power supply terminal VGH4_O connected to the second level conversion sub-circuit 10 may be higher than the level of the first power supply terminal VGH2_O.

Figure 10:
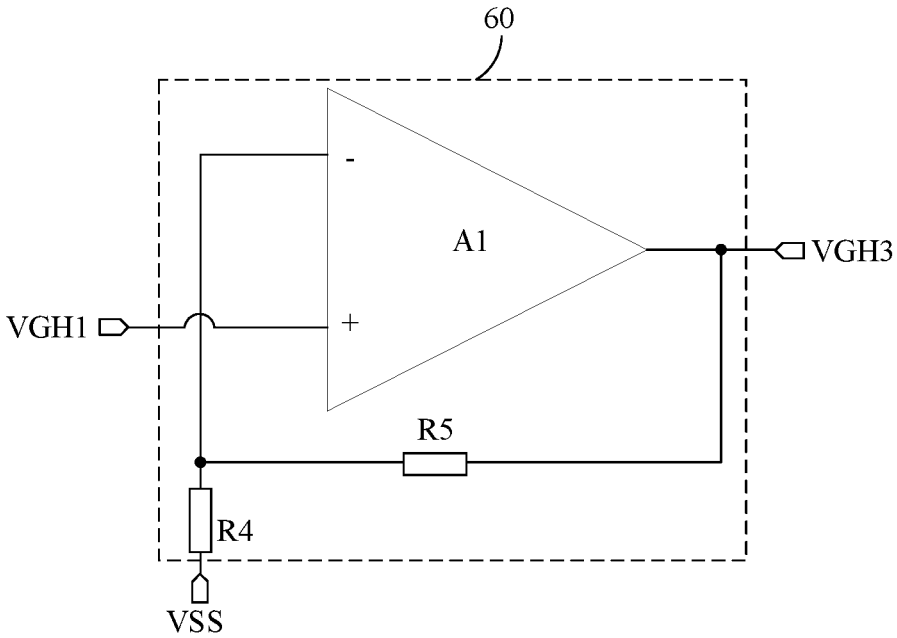
FIG. 10 is a partial structural schematic diagram of still another level conversion circuit according to an embodiment of the present disclosure.

FIG. 10 shows a structural schematic diagram of an amplification sub-circuit by taking the amplification sub-circuit 60 connected to the first initial power supply terminal VGH1 and the first initial power supply terminal VGH3 as an example. As shown in FIG. 10, each amplification sub-circuit 60 may include an amplifier A1, a fourth resistor R4 and a fifth resistor R5.

A positive input terminal of the amplifier A1 may be connected to one first initial power supply terminals (e.g., VGH1), a negative input terminal of the amplifier A1 may be connected to one end of the fourth resistor R4 and one end of the fifth resistor R5, and an output terminal of the amplifier A1 may be connected to another first initial power supply terminals (e.g., VGH3).

The other end of the fourth resistor R4 may be connected to a second DC power supply terminal VSS, and the other end of the fifth resistor R5 may be connected to an output terminal of the amplifier A1. In some implementations, the second DC power supply terminal VSS may be a ground terminal.

By taking the amplification sub-circuit 60 shown in FIG. 10 as an example, it can be known according to the operating principle of the amplifier A1 that the level of the first initial power supply terminal VGH3 may satisfy VGH3=VGH1 (1+R5/R4). Therefore, the first initial power supply signal at the required level may be acquired by flexibly setting the resistance of the fourth resistor R4 and the resistance of the fifth resistor R5.

In addition, the turn-on voltage of the transistor in the GOA circuit presents negative temperature characteristics, that is, the higher voltage is required in order to effectively turn on the transistor at the low temperature. Therefore, in order to further ensure the better product reliability, in the embodiments of the present disclosure, the first initial power supply signal transmitted to the level conversion sub-circuit may be further controlled based on ambient temperature. That is, with reference to FIG. 10, whether the second switch sub-circuit 50 transmits the first initial power supply signal provided by the first initial power supply terminal VGH1 to the first level conversion sub-circuit 10 or the second switch sub-circuit 50 transmits the first initial power supply signal provided by the first initial power supply terminal VGH3 to the first level conversion sub-circuit 10 may be further set based on the ambient temperature. The same applies to the second level conversion sub-circuit 10. Thus, it is ensured that the power supply signal effectively turning on the transistor in the GOA circuit may be output at the lower temperature.

Figure 11:
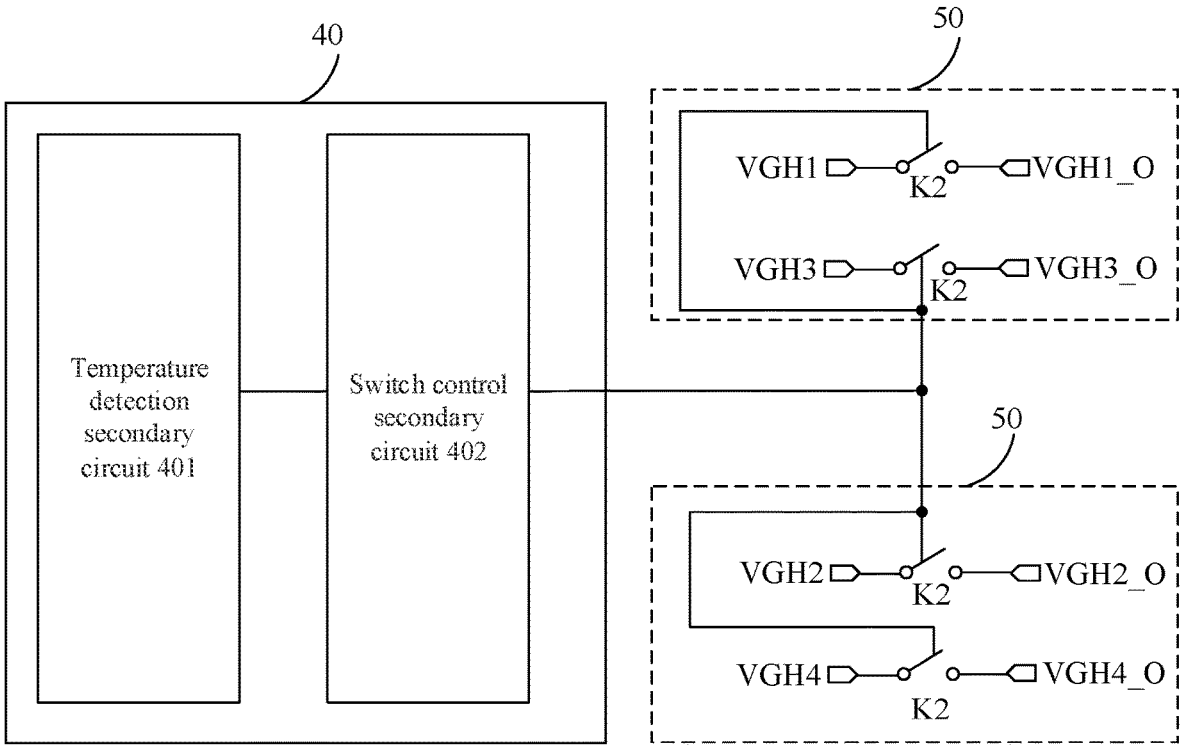
FIG. 11 is a partial structural schematic diagram of still another level conversion circuit according to an embodiment of the present disclosure.

In some implementations, in order to achieve the above functions, FIG. 11 shows a structural schematic diagram of still another level conversion circuit. As shown in FIG. 11, the switch control sub-circuit 40 in the level conversion circuit may include a temperature detection secondary circuit 401 and a switch control secondary circuit 402.

The temperature detection secondary circuit 401 may be connected to the switch control secondary circuit 402, and configured to transmit an initial control signal to the switch control secondary circuit 402 based on a detected temperature.

The switch control secondary circuit 402 may be connected to each of the second switch sub-circuits 50, and configured to transmit a second switch control signal to each of the second switch sub-circuits 50 based on the initial control signal.

That is, the switch control sub-circuit 40 may detect temperature, and flexibly provide the second control signal to the second switch sub-circuits 50 based on the detected temperature.

Figure 12:
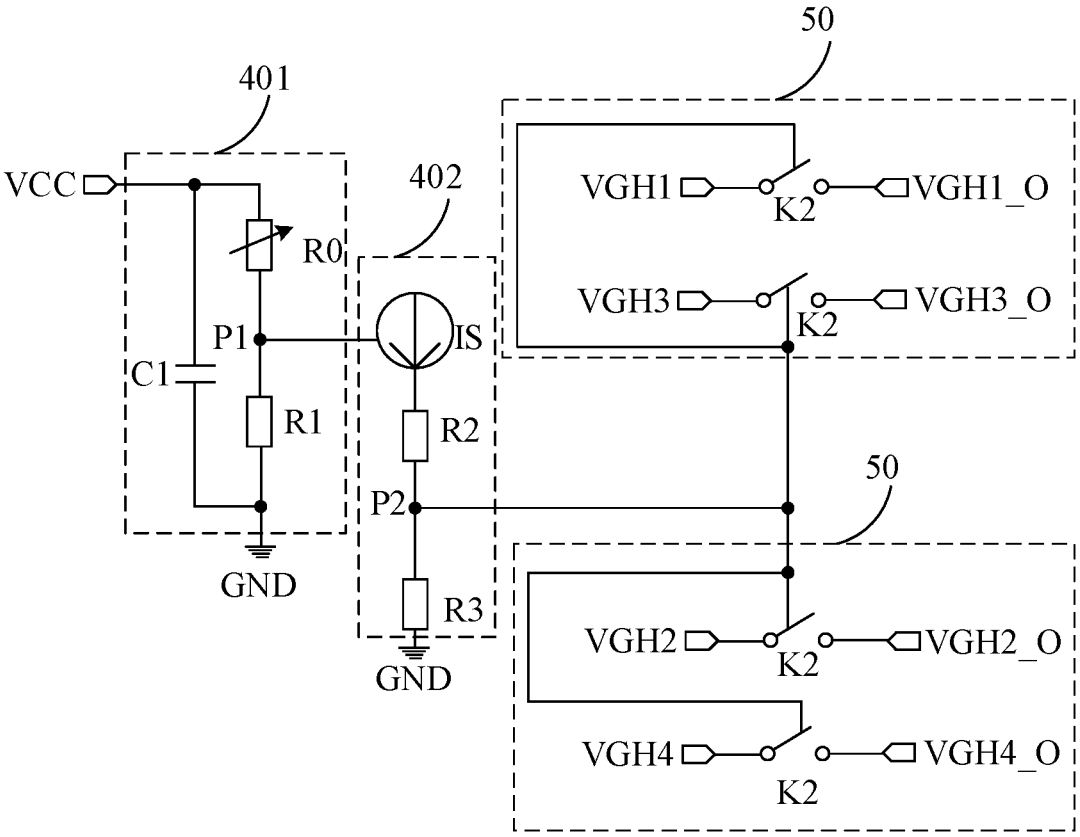
FIG. 12 is a partial structural schematic diagram of still another level conversion circuit according to an embodiment of the present disclosure.

In some implementations, FIG. 12 is a structural schematic diagram of still another level conversion circuit according to an embodiment of the present disclosure. As shown in FIG. 12, the temperature detection secondary circuit 401 may include a thermistor R0, a first resistor R1 and a capacitor C1; and the switch control secondary circuit 402 may include a current source IS, a second resistor R2 and a third resistor R3.

One end of the thermistor R0 and one end of the capacitor C1 may be both connected to a first DC: power supply terminal VCC, the other end of the thermistor R0 may be connected to a first node P1, and the other end of the capacitor C1 may be connected to a second DC power supply terminal VSS. In some implementations, the second DC power supply terminal shown in FIG. 12 is a ground terminal GND.

One end of the first resistor R1 may be connected to the first node P1, and the other end of the first resistor R1 may be connected to the second DC power supply terminal VSS.

The current source IS may be connected to the first node P1 and one end of the second resistor R2, and the other end of the second resistor R2 may be connected to a second node P2.

One end of the third resistor R3 may be connected to the second node P2, the other end of the third resistor R3 may be connected to the second DC power supply terminal VSS, and the second node P2 may be connected to each of the second switch sub-circuits 50.

In some implementations, the thermistor R0 may be a positive temperature-sensitive resistor with the smaller resistance at the lower temperature. With reference to the switch control sub-circuit shown in FIG. 12, assuming that a level of the first DC power supply terminal VCC is represented by Vcc, a resistance of the thermistor R0 is represented by r0, a resistance of the first resistor R1 is represented by r1, and a resistance of the second resistor R2 is represented by r2, then it may be determined that the level of the first node P1 satisfies the following formula:

$$Vp1=Vcc*r1/(r0+r1)=Vcc/[1+(r0/r1)]$$

Figure 13:
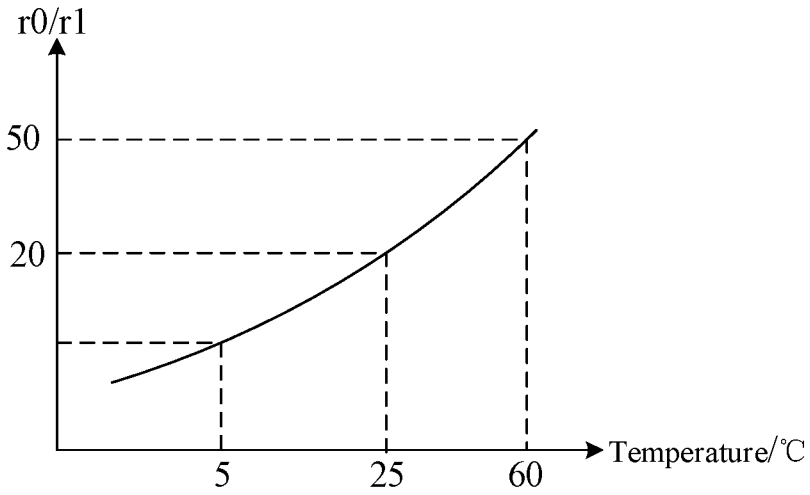
FIG. 13 is a curve schematic diagram showing a change of a resistance ratio with temperature according to an embodiment of the present disclosure.

Fro on the above formula, it can be seen that the levels of the first node P1 and the second node P2 can be flexibly controlled by selecting the suitable thermistor R0 and first resistor R1, For example, it may be determined from the curve diagram showing the change of r0/r1 along with temperature in FIG. 13 that, r0 may satisfy r0≈50*r1 to 20*r1 at the normal temperature and at the high temperature; and r0 may satisfy r0≈r1/10 at the low temperature. In FIG. 13, the abscissa represents the temperature in degree centigrade (° C.), and the ordinate represents the value of r0/r1.

In combination with the structure shown in FIG. 12 and the influence of high-temperature and low-temperature environment, in order to effectively turn on the transistor of the GOA circuit at the low temperature, the first initial power supply signal at the higher level may be provided to the level conversion sub-circuit at the low temperature, and the first initial power supply signal at the lower level may be provided to the level conversion sub-circuit at the high temperature or at the normal temperature. In order to achieve this technical effect, the level of the second node P2 may be flexibly adjusted through the temperature detection secondary circuit 401 so as to adjust the level of the second switch control signal, such that different second switches K2 in each second switch sub-circuit 50 may be controlled to be turned on or turned off at different temperatures.

For example, as described in the above embodiment, it is assumed that the level of the first initial power supply terminal VGH1 is lower than the level of the first initial power supply terminal VGH3, and the level of the first initial power supply terminal VGH2 is lower than the level of the first initial power supply terminal VGH4. The second switches K2 connected to the first initial power supply terminal VGH1 and the first initial power supply terminal VGH2 are turned on in response to the second switch control signal at the low level, and the second switches K2 connected to the first initial power supply terminal VGH3 and the first initial power supply terminal VGH4 are turned on in response to the second switch control signal at the high level. Then, the second node P2 is controlled to be at the high level through the temperature detection secondary circuit 401 at the low temperature, and the second node P2 is controlled to be at the low level through the temperature detection secondary circuit 401 at the high temperature or at the normal temperature, such that the level of the first initial power supply signal transmitted to the level conversion sub-circuit at the low temperature is higher than the level of the first initial power supply signal transmitted to the level conversion sub-circuit at the high temperature and at the normal temperature. For example, Table 2 is an output relationship table at different temperatures.

TABLE 2

| Environment | P1 | P2 | First power supply signal that may be transmitted by the first level conversion sub-circuit | First power supply signal that may be transmitted by the second level conversion sub-circuit |
|---|---|---|---|---|
| High temperature/ normal temperature | L | L | VGH1_O | VGH2_O |
| Low temperature | H | H | VGH3_O | VGH4_O |

Here, L represents the low level, and represents the high level. It can be seen from the above Table 2 that, each level conversion sub-circuit 10 may transmit the first power supply signals VGH3_O and VGH4_O at the higher level to the output signal terminal at the low temperature; and each level conversion sub-circuit 10 may transmit the first power supply signals VGH1_O and VGH2_O at the lower level to the output signal terminal at the high temperature and at the normal temperature.

In some implementations, the level conversion circuit 01 in the embodiments of the present disclosure may be a circuit manufactured on a flexible or printed circuit board and the level conversion circuit 01 does not affect the wiring space of the GOA circuit or increases the border width of the product. In addition, the level conversion circuit provided in the embodiments of the present disclosure can not only provide signals at different high levels and signals at different low levels to different signal terminals connected to the GOA circuit, but also flexibly adjust the levels of signals output to the GOA circuit based on the ambient temperature, thereby effectively improving the product reliability. Furthermore, the level conversion circuit according to the embodiments of the present disclosure is applicable to GOA circuit products with thin film transistors (TFT) made of different materials, such as TFTs made of oxide materials and low temperature poly-silicon (LTPS) materials, and thus the level conversion circuit has a stronger versatility.

In summary, the embodiment of the present disclosure provides a level conversion circuit. The level conversion circuit includes at least one first switch sub-circuit and at least two level conversion sub-circuits. Each first switch sub-circuit may control each level conversion sub-circuit to transmit a first power supply signal or a second power supply signal to a gate driving circuit, and the first power supply signals provided by the respective level conversion sub-circuits are at different levels, and the second power supply signals provided by the respective level conversion sub-circuits are at different levels. Therefore, the first power supply signals at different levels and the second power supply signals at different levels can be provided to different signal terminals connected to the gate driving circuit, thereby improving the product reliability, and achieving the better display effect of the display panel.

Figure 14:
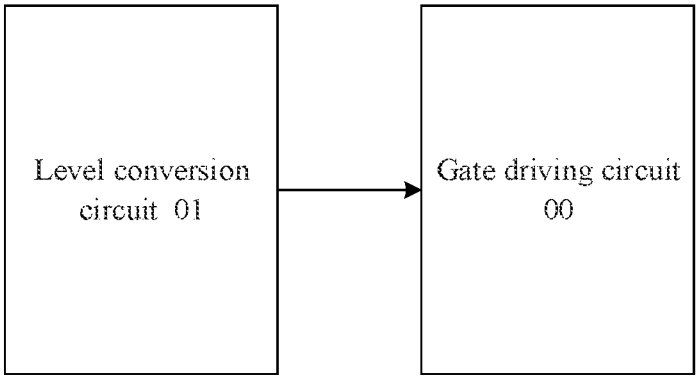
FIG. 14 is a structural schematic diagram of a driving circuit for a display panel according to an embodiment of the present disclosure.

FIG. 14 is a structural schematic diagram of a driving circuit for a display panel according to an embodiment of the present disclosure. As shown in FIG. 14, the driving circuit for the display panel may include a gate driving circuit 00 and the level conversion circuit 01 as shown in any one of FIG. 1 to FIG. 12.

In some implementations, the gate driving circuit 00 may be manufactured on an array substrate of the display panel, and the level conversion circuit 01 may be manufactured on a flexible or printed circuit board.

The level conversion circuit 01 may be connected to the gate driving circuit 00, and configured to provide a driving signal to the gate driving circuit 00. The gate driving circuit 00 may be configured to operate under the drive of the driving signal. In some implementations, with reference to the above figures, the level conversion circuit 01 may be connected to various signal terminals of the gate driving circuit 00 through the output signal terminals.

In some implementations, a transistor in the gate driving circuit may be made of a metal oxide semiconductor material.

In an example embodiment, the metal oxide semiconductor material may be indium gallium zinc oxide (IGZO), or other materials with changeable carrier mobility, such as indium gallium tin oxide (IGTO), indium gallium zinc tin oxide (IGZTO) and Ln-indium zinc oxide (Ln-IZO). Compared with the silicon (Si) material, the IGZO material can enable the transistor to have a higher mobility, a larger turn-on current Ion, and a smaller turn-off current Ioff, which can further improve the product reliability. In addition, the metal oxide semiconductor may also lay a foundation for a high refresh rate of the display panel.

Figure 15:
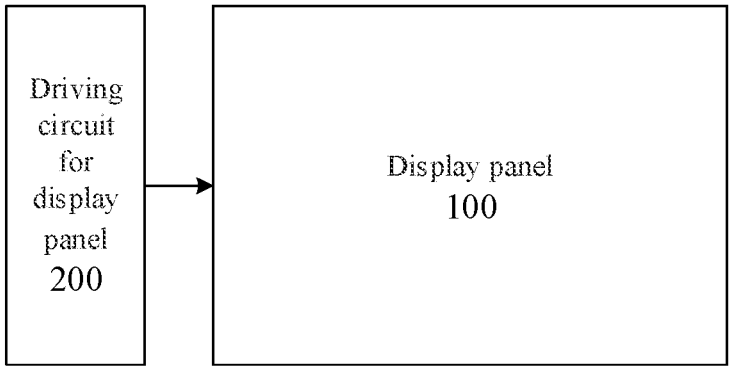
FIG. 15 is a structural schematic diagram of a display apparatus according to an embodiment of the present disclosure.

FIG. 15 is a structural schematic diagram of a display apparatus according to an embodiment of the present disclosure. As shown in FIG. 15, the display apparatus may include a display panel 100, and the driving circuit for the display panel 200 as shown in FIG. 14.

The driving circuit for the display panel 200 may be connected to the display panel 100, and configured to drive the display panel 100 to display.

In some implementations, the display apparatus may be any product or component with a display function, such as an organic light-emitting diode display apparatus, a liquid crystal display apparatus, a mobile phone, a tablet computer, a television, a display, a laptop computer or a navigator.

It should be understood that the terms "first", "second", and the like in the specification and claims of the embodiments of the present disclosure and in the above drawings are intended to distinguish between similar objects but do not necessarily indicate a specific order or sequence. It should be understood that term such used may be exchanged under proper conditions, for example, the data may be implemented in an order other than those illustrated or described the embodiments of the present disclosure.

Described above are merely optional embodiments of the present disclosure, and are not intended to limit the present disclosure. Within the spirit and principles of the present disclosure, any modifications, equivalent substitutions, improvements, and the like are within the protection scope of the present disclosure.

What is claimed is:

1. A level conversion circuit, comprising:

at least two level conversion sub-circuits; and at least one first switch sub-circuit; wherein each of the at least one first switch sub-circuit is connected to at least one of a plurality of input control terminals and at least one of the level conversion sub-circuits; and each of the at least one first switch sub-circuit is configured to provide an input control signal provided by each connected input control terminal to the connected level conversion sub-circuit in response to a first switch control signal; and each of the level conversion sub-circuits is further connected to at least one first power supply terminal, at least one second power supply terminal and at least one of a plurality of output signal terminals, each of the output signal terminals being further connected to a gate driving circuit; and each of the level conversion sub-circuits is configured to transmit, in response to the received input control signal, a first power supply signal provided by one first power supply terminal or a second power supply signal provided by one second power supply terminal to each connected output signal terminal;

wherein the first power supply signals provided by the first power supply terminals connected to the at least two level conversion sub-circuits are at different levels, and the second power supply signals provided by the second power supply terminals connected to the at least two level conversion sub-circuits are at different levels.

2. The level conversion circuit according to claim 1, wherein each of the at least one first switch sub-circuit comprises a plurality of first switches; wherein a control terminal of each of the first switches is configured to receive the first switch control signal, a first terminal of each of the first switches is connected to one of the plurality of input control terminals, and a second terminal of each of the first switches is connected to one of the level conversion sub-circuits.

3. The level conversion circuit according to claim 2, wherein a number of the first switches in each of the at least one first switch sub-circuit is the same as a number of the plurality of input control terminals, and the first switches are connected to the input control terminals in one-to-one correspondence.

4. The level conversion circuit according to claim 1, comprising a plurality of first switch sub-circuits; wherein each of the plurality of first switch sub-circuits is connected to the plurality of input control terminals and one of the level conversion sub-circuits, and each of the level conversion sub-circuits is connected to the plurality of output signal terminals.

5. The level conversion circuit according to claim 1, wherein each of the level conversion sub-circuits is connected to a plurality of first power supply terminals and one second power supply terminal; and the level conversion circuit further comprises a switch control sub-circuit and at least two second switch sub-circuits, a number of the second switch sub-circuits in the level conversion circuit being the same as a number of the level conversion sub-circuits; wherein the switch control sub-circuit is connected to each of the second switch sub-circuits, and configured to transmit a second switch control signal to each of the second switch sub-circuits; and each of the second switch sub-circuits is further connected to a plurality of first initial power supply terminals and the plurality of first power supply terminals, the plurality of first initial power supply terminals being in one-to-one correspondence with the plurality of first power supply terminals; and each of the second switch sub-circuits is configured to transmit, in response to the second switch control signal, a first initial power supply signal provided by one first initial power supply terminal to one corresponding first power supply terminal, wherein the first initial power supply signals provided by the plurality of first initial power supply terminals are at different levels.

6. The level conversion circuit according to claim 5, wherein the switch control sub-circuit comprises a temperature detection secondary circuit and a switch control secondary circuit; wherein the temperature detection secondary circuit is connected to the switch control secondary circuit, and configured to transmit an initial control signal to the switch control secondary circuit based on detected temperature; and the switch control secondary circuit is connected to each of the second switch sub-circuits, and configured to transmit a second switch control signal to each of the second switch sub-circuits based on the initial control signal.

7. The level conversion circuit according to claim 6, wherein the temperature detection secondary circuit comprises a thermistor, a first resistor and a capacitor; and the switch control secondary circuit comprises a current source, a second resistor and a third resistor; wherein one end of the thermistor and one end of the capacitor are both connected to a first DC power supply terminal, the other end of the thermistor is connected to a first node, and the other end of the capacitor is connected to a second DC power supply terminal;

one end of the first resistor is connected to the first node, and the other end of the first resistor is connected to the second DC power supply terminal;

the current source is connected to the first node and one end of the second resistor, and the other end of the second resistor is connected to a second node; and one end of the third resistor is connected to the second node, the other end of the third resistor is connected to the second DC power supply terminal, and the second node is connected to each of the second switch sub-circuits.

8. The level conversion circuit according to claim 5, wherein each of the second switch sub-circuits comprises a plurality of second switches; wherein a control terminal of each of the second switches is connected to the switch control sub-circuit, a first terminal of each of the second switches is connected to one first initial power supply terminal, and a second terminal of each of the second switches is connected to one first power supply terminal.

9. The level conversion circuit according to claim 8, wherein each of the level conversion sub-circuits is connected to two first power supply terminals; and each of the second switch sub-circuits is connected to two first initial power supply terminals and comprises two second switches.

10. The level conversion circuit according to claim 9, further comprising at least two amplification sub-circuits, a number of the amplification sub-circuits in the level conversion circuit being the same as the number of the level conversion sub-circuits; wherein an input terminal of each of the amplification sub-circuits is connected to one of the two first initial power supply terminals, and an output terminal of each of the amplification sub-circuits is connected to the other of the two first initial power supply terminals; and each of the amplification sub-circuits is configured to amplify a first initial power supply signal provided by one of the first initial power supply terminals and transmits the amplified first initial power supply signal to the other of the first initial power supply terminals.

11. The level conversion circuit according to claim 10, wherein each of the amplification sub-circuits comprises an amplifier, a fourth resistor and a fifth resistor; wherein a positive input terminal of the amplifier is connected to one of the two first initial power supply terminals, a negative input terminal of the amplifier is connected to one end of the fourth resistor and one end of the fifth resistor, and an output terminal of the amplifier is connected to the other of the two first initial power supply terminals;

the other end of the fourth resistor is connected to a second DC power supply terminal; and the other end of the fifth resistor is connected to the output terminal of the amplifier.

12. The level conversion circuit according to any claim 1, further comprising an inverter sub-circuit; wherein the inverter sub-circuit is connected to the plurality of input control terminals and each first switch sub-circuit, and configured to invert the input control signal provided by each of the input control terminals and transmits the input control signal to each first switch sub-circuit.

13. The level conversion circuit according to claim 12, wherein the inverter sub-circuit comprises a plurality of NOT gates; wherein an input terminal of each of the NOT gates is connected to one of the input control terminals, and an output terminal of each of the NOT gates is connected to a first terminal of one first switch in each first switch sub-circuit.

14. The level conversion circuit according to any claim 1, comprising two level conversion sub-circuits.

15. The level conversion circuit according to claim 14, comprising two first switch sub-circuits.

16. The level conversion circuit according to claim 1, wherein each of the level conversion sub-circuits comprises a first transistor and a second transistor; wherein a gate of the first transistor is connected to the first switch sub-circuit, a first electrode of the first transistor is connected to at least one first power supply terminal, and a second electrode of the first transistor is connected to at least one of the output signal terminals; and a gate of the second transistor is connected to the first switch sub-circuit, a first electrode of the second transistor is connected to at least one second power supply terminal, and a second electrode of the second transistor is connected to at least one of the output signal terminals.

17. The level conversion circuit according to claim 11, comprising a plurality of first switch sub-circuits; wherein each of the first switch sub-circuits is connected to the plurality of input control terminals and one of the level conversion sub-circuits, and each of the level conversion sub-circuits is connected to the plurality of output signal terminals;

the switch control sub-circuit comprises a temperature detection secondary circuit and a switch control secondary circuit; wherein the temperature detection secondary circuit is connected to the switch control secondary circuit, and configured to transmit an initial control signal to the switch control secondary circuit based on detected temperature; and the switch control secondary circuit is connected to each of the second switch sub-circuits, and configured to transmit a second switch control signal to each of the second switch sub-circuits based on the initial control signal; wherein the temperature detection secondary circuit comprises a thermistor, a first resistor and a capacitor; and the switch control secondary circuit comprises a current source, a second resistor and a third resistor; wherein one end of the thermistor and one end of the capacitor are both connected to a first DC power supply terminal, the other end of the thermistor is connected to a first node, and the other end of the capacitor is connected to a second DC power supply terminal;

one end of the first resistor is connected to the first node, and the other end of the first resistor is connected to the second DC power supply terminal;

the current source is connected to the first node and one end of the second resistor, and the other end of the second resistor is connected to a second node; and one end of the third resistor is connected to the second node, the other end of the third resistor is connected to the second DC power supply terminal, and the second node is connected to each of the second switch sub-circuits;

the level conversion circuit further comprises an inverter sub-circuit, wherein the inverter sub-circuit is connected to the plurality of input control terminals and each of the first switch sub-circuits, and configured to invert an input control signal provided by each of the input control terminals and transmit the input control signal to each of the first switch sub-circuits;

wherein the inverter sub-circuit comprises a plurality of NOT gates, wherein an input terminal of each of the NOT gates is connected to one of the input control terminals, and an output terminal of each of the NOT gates is connected to a first terminal of one first switch in each of the first switch sub-circuits; and the level conversion circuit comprises two level conversion sub-circuits and two first switch sub-circuits; wherein each of the level conversion sub-circuits comprises a first transistor and a second transistor; wherein a gate of the first transistor is connected to one of the two first switch sub-circuits, a first electrode of the first transistor is connected to at least one first power supply terminal, and a second electrode of the first transistor is connected to at least one of the output signal terminals; and a gate of the second transistor is connected to the other of the two first switch sub-circuits, a first electrode of the second transistor is connected to at least one second power supply terminal, and a second electrode of the second transistor is connected to at least one of the output signal terminals.

18. A driving circuit for a display panel, comprising a gate driving circuit, and a level conversion circuit, wherein the level conversion circuit is connected to the gate driving circuit and configured to provide a driving signal to the gate driving circuit, and the gate driving circuit is configured to operate under the drive of the driving signal; and the level conversion circuit comprises:

at least two level conversion sub-circuits; and at least one first switch sub-circuit; wherein each of the at least one first switch sub-circuit is connected to at least one of a plurality of input control terminals and at least one of the level conversion sub-circuits; and each of the at least one first switch sub-circuit is configured to provide an input control signal provided by each connected input control terminal to the connected level conversion sub-circuit in response to a first switch control signal; and each of the level conversion sub-circuits is further connected to at least one first power supply terminal, at least one second power supply terminal and at least one of a plurality of output signal terminals, each of the output signal terminals being further connected to a gate driving circuit; and each of the level conversion sub-circuits is configured to transmit, in response to the received input control signal, a first power supply signal provided by one first power supply terminal or a second power supply signal provided by one second power supply terminal to each connected output signal terminal;

wherein the first power supply signals provided by the first power supply terminals connected to the at least two level conversion sub-circuits are at different levels, and the second power supply signals provided by the second power supply terminals connected to the at least two level conversion sub-circuits are at different levels.

19. The driving circuit for the display panel according to claim 18, wherein a transistor in the gate driving circuit is made of a metal oxide semiconductor material.

20. A display apparatus, comprising a display panel, and a driving circuit for the display panel, wherein the driving circuit for the display panel is connected to the display panel, and configured to drive the display panel to display; and the driving circuit for a display panel, comprising a gate driving circuit, and a level conversion circuit, wherein the level conversion circuit is connected to the gate driving circuit and configured to provide a driving signal to the gate driving circuit, and the gate driving circuit is configured to operate under the drive of the driving signal; and the level conversion circuit comprises:

at least two level conversion sub-circuits; and at least one first switch sub-circuit; wherein each of the at least one first switch sub-circuit is connected to at least one of a plurality of input control terminals and at least one of the level conversion sub-circuits; and each of the at least one first switch sub-circuit is configured to provide an input control signal provided by each connected input control terminal to the connected level conversion sub-circuit in response to a first switch control signal; and each of the level conversion sub-circuits is further connected to at least one first power supply terminal, at least one second power supply terminal and at least one of a plurality of output signal terminals, each of the output signal terminals being further connected to a gate driving circuit; and each of the level conversion sub-circuits is configured to transmit, in response to the received input control signal, a first power supply signal provided by one first power supply terminal or a second power supply signal provided by one second power supply terminal to each connected output signal terminal;

wherein the first power supply signals provided by the first power supply terminals connected to the at least two level conversion sub-circuits are at different levels, and the second power supply signals provided by the second power supply terminals connected to the at least two level conversion sub-circuits are at different levels.

* * * * *